US005690390A

United States Patent [19]

Bithell

[11] Patent Number: 5,690,390

[45] Date of Patent: Nov. 25, 1997

[54] PROCESS FOR SOLUTION MINING UNDERGROUND EVAPORITE ORE FORMATIONS SUCH AS TRONA

[75] Inventor: Michael M. Bithell, Green River, Wyo.

[73] Assignee: FMC Corporation, Philadelphia, Pa.

[21] Appl. No.: 635,135

[22] Filed: Apr. 19, 1996

[51] Int. Cl.[6] ..... E21B 43/28

[52] U.S. Cl. ..... 299/4; 166/50; 299/5

[58] Field of Search ..... 299/4, 5; 166/50, 166/268, 270

[56] References Cited

U.S. PATENT DOCUMENTS

| | | | |
|---|---|---|---|
| H614 | 4/1989 | Norman, Sr. | 299/4 |
| 2,388,009 | 10/1945 | Pike | 423/206.1 |
| 2,625,384 | 1/1953 | Pike et al. | 299/2 |
| 3,050,290 | 8/1962 | Caldwell et al. | 299/4 |
| 3,119,655 | 1/1964 | Frint et al. | 423/186 |
| 3,184,287 | 5/1965 | Gancy | 423/198 |
| 3,953,073 | 4/1976 | Kube | 299/5 |
| 4,815,790 | 3/1989 | Rosar et al. | 299/4 |
| 5,246,273 | 9/1993 | Rosar | 299/4 |
| 5,431,482 | 7/1995 | Russo | 299/4 |

FOREIGN PATENT DOCUMENTS

| | | | |
|---|---|---|---|
| 240929 | 11/1986 | Germany | 299/4 |
| 876968 | 10/1981 | U.S.S.R. | 299/4 |

*Primary Examiner*—David J. Bagnell

*Attorney, Agent, or Firm*—Anthony L. Cupoli; Frank Ianno

[57] ABSTRACT

A process is described for solution mining isolated, mechanically mined-out areas of soluble evaporite ore to recover remaining ore reserves, wherein the mined-out areas are separated from an operational mine area by barrier pillars of the evaporite ore, by drilling at least one vertical well bore from the surface to a predefined distance above the evaporite ore body, converting the drilling of the vertical well bore to a substantially horizontal well bore at a predetermined distance below the ground level, continuing the drilling parallel to and within the evaporite ore body to form a well bore one end of which is connected to the mined-out area, developing a connection from the operating mine area to the other end of the well bore, drilling an injection well from the surface into the mined-out area, injecting an aqueous solvent into the injection well, passing the solvent into the mined-out area, removing solvent enriched in dissolved evaporite ore from the mined-out area, passing such enriched solvent from the mined-out area into the well bore connecting the mined-out area and the operational mine area, removing enriched solvent from the well bore end connected to the operational mine area and recovering the enriched solvent.

5 Claims, 2 Drawing Sheets

PROCESS FOR SOLUTION MINING UNDERGROUND EVAPORITE ORE FORMATIONS SUCH AS TRONA

This invention relates to an improved process for recovering soluble chemicals, including sodium chemicals such as sodium carbonate and/or sodium bicarbonate values from underground soluble evaporite ore formations, especially trona, useful in manufacturing soda ash, sodium bicarbonate, caustic soda, sodium carbonate decahydrate, sodium carbonate monohydrate and other sodium chemicals, and especially to the recovery of these sodium chemicals from aqueous brine solutions obtained by dissolving such underground evaporite ore formations.

In southwestern Wyoming, in the vicinity of Green River, a vast deposit of crude, mineral trona ($Na_2CO_3$—$NaHCO_3 2H_2O$) which lies some 800 to 3000 feet beneath the surface of the earth has been discovered. Other such underground deposits of trona have also been discovered in Turkey and China. The main trona bed at Green River is present as a seam about 12 feet in thickness at approximately the 1500 foot level analyzing about 90% trona. The Green River trona beds cover 100 square miles and consist of several different beds which generally overlap each other and are separated by layers of shale. In some areas, the trona beds occur over a 400 foot stratum with ten or more layers comprising 25% of the total stratum. The quality of the trona varies greatly, of course, depending on its location in the stratum.

A typical analysis of this crude trona being mined at Green River, Wyoming, is as follows:

| Constituent | Percent |
|---|---|
| Sodium Sesquicarbonate | 90.00 |
| NaCl | 0.1 |
| $Na_2SO_4$ | 0.02 |
| Organic Matter | 0.3 |
| Insolubles | 9.58 |
| | 100.00 |

As seen in the above analysis, the main constituent of crude trona is sodium sesquicarbonate. The amount of impurities, primarily shale and other nonsoluble materials, is sufficiently large that this crude trona cannot be directly converted into products which can be utilized in many commercial processes. Therefore, the crude trona is normally purified to remove or reduce the impurities before its valuable sodium content can be sold commercially as: soda ash ($Na_2CO_3$), sodium bicarbonate ($NaHCO_3$), caustic soda (NaOH), sodium sesquicarbonate ($Na_2CO_3.NaHCO_3.2H_2O$), a sodium phosphate ($Na_5P_3O_{10}$) or other sodium-containing chemicals.

One major use for the crude trona is to convert and refine it into soda ash. In order to convert the sodium sesquicarbonate content of the trona to soda ash in commercially feasible operations, two distinct types of processes are employed. These are the "Sesquicarbonate Process" and the "Monohydrate Process".

The "Sesquicarbonate Process" for purifying crude trona and producing a purified soda ash is by a series of steps involving: dissolving the crude mined trona in a cycling, hot mother liquor containing excess normal carbonate over bicarbonate in order to dissolve the trona congruently, clarifying the insoluble muds from the solution, filtering the solution, passing the filtrate to a series of vacuum crystallizers where water is evaporated and the solution is cooled causing sodium sesquicarbonate to crystallize out as the stable crystal phase, recycling the mother liquor to dissolve more crude trona and calcining the sesquicarbonate crystals at a temperature sufficient to convert same to soda ash.

A more direct and simplified method which was subsequently developed is the "Monohydrate Process" which yields a dense, organic-free soda ash by a series of steps involving: calcining the crude trona at a temperature of 400° C. to 800° C. to convert it to crude sodium carbonate and removing the organics by oxidation and distillation, dissolving the crude sodium carbonate in water, clarifying the resulting sodium carbonate solution to remove insolubles as muds therefrom, filtering the solution, evaporating water from the clarified and filtered sodium carbonate solution in an evaporator circuit, crystallizing from the pregnant mother liquor sodium carbonate monohydrate, calcining the monohydrate crystals to produce dense, organic-free soda ash and recycling the mother liquor from the crystals to the evaporating step.

The calcination of the crude trona in the above process has a threefold effect. First, by calcining between a temperature of about 400° C. to 800° C., the organic matter present in the crude trona is removed. Secondly, the calcination effects a conversion of the bicarbonate present in the crude trona to sodium carbonate. Lastly, the crude sodium carbonate resulting from the decarbonation has a greater rate of solubility than the crude trona. A comparison of the solubility rates is set forth in Table I.

TABLE I

| | Percent $Na_2CO_3$ in Solution | |
|---|---|---|
| Time, Minutes | Crude Trona | Crude Sodium Carbonate |
| 1 | 13 | 31.5 |
| 2 | 17 | 32.5 |
| 3 | 18.5 | 32.5 |
| 5 | 19 | 32.0 |

The ore used in the "Sesquicarbonate Process" and "Monohydrate Process" is conventionally dry mined trona obtained by sinking shafts of 1500 feet or so and utilizing miners and machinery to dig out the ore. The underground mining techniques vary, including room and pillar mining, continuous mining, long wall mining, etc., and all have been employed to improve mining efficiency depending on the mine depth and ore variations. However, because of the depth of the mine and the need to have miners and machinery operating underground to dig and convey the ore to the surface, the cost of mining the ore is a significant part of the cost of producing the final product.

One mining technique which has been tested and developed to avoid the high cost of having miners and machinery underground is solution mining. In its simplest form, solution mining is carded out by contacting a sodium-containing ore such as trona with a solvent such as water to dissolve the ore and form a brine containing dissolved sodium values. The brine is then recovered and used as feed material to process it into one or more sodium salts. The difficulty with solution mining an ore such as trona is that it is an incongruently dissolving double salt that has a relatively slow dissolving rate and requires high temperatures to achieve maximum solubility and to yield highly concentrated solutions which are required for high efficiency in present processing plants. Further, solution mining may also yield over time brine solutions of varying strength, which must be accommodated by the processing plant. Also, the brine may be contaminated with chlorides, sulfates and the like, which are difficult to remove when processing the brines into sodium-containing chemicals.

In an effort to improve solution mining processes, it was first proposed in U.S. Pat. No. 2,388,009 issued to R. D. Pike on Oct. 30, 1945 that a hot mother liquor containing excess sodium carbonate be circulated underground to achieve a brine saturation at temperatures above 85° C. for use in sodium sesquicarbonate production. When tested, this system did not yield the saturated exit brine desired for commercial application despite inordinately high inlet temperatures and excessive heat losses.

Another proposal in U.S. Pat. No. 2,625,384 issued to R. D. Pike, et al. on Jan. 13, 1953 used water as a solvent under essentially ambient temperatures to extract trona underground in mined areas, but the dilute solution had to be enriched by heating and dissolving additional mechanically mined trona in it before being processed into soda ash. The process has never been found workable. Entering such mined areas which may no longer have roof bolts and in which subsidence of the area has commenced is too hazardous for normal practice.

Other patents involved in solution mining such as U.S. Pat. No. 3,119,655 issued to W. R. Frint, et al. on Jan. 28, 1964 and U.S. Pat. No. 3,050,290 issued to N. A. Caldwell, et at. continued to advocate use of high solvent temperatures to increase trona dissolution, with the '655 patent also teaching fortifying the recovered hot brine with a mother liquor containing sufficient sodium carbonate values to yield a solution from which sodium sesquicarbonate will precipitate.

In all of these prior art solution mining processes, the intent was to use either a heated aqueous solvent, or to fortify the recovered brine with added alkali values, to produce a highly concentrated solution which could be economically processed in the conventional Monohydrate Process or Sesquicarbonate Process, described above.

Another approach, not involving a heated aqueous solution as the solvent, was revealed in U.S. Pat. No. 3,184,287 issued to A. B. Gancy on May 18, 1965. This involved using sodium hydroxide (caustic soda) in the aqueous solvent to increase the dissolving rate and to reach a high solubility of trona values at low temperatures and to achieve congruent dissolving. This process uses a caustic soda solution in excess of 3% NaOH by weight to achieve brine solutions containing in excess of 19% sodium carbonate which can be processed into soda ash via the monohydrate process, i.e., evaporation to yield sodium carbonate monohydrate crystals. This process was placed into practice in 1984 and has resulted in exit well brine solutions containing up to 28% sodium carbonate, which can be readily processed economically into soda ash. However, this level of sodium carbonate concentration requires an inlet solvent containing about 8% caustic soda. This caustic soda solvent is expensive to manufacture in such quantities required for underground solution mining.

U.S. Pat. No. 3,953,073 issued to W. H. Kube on Apr. 27, 1976 pointed out that using less caustic in the solvent (1%–3%) resulted in more soda ash values in the outlet brine per ton of caustic soda required, if the brine were heated and saturated at elevated temperatures. However, the resulting brine contains a more dilute soda ash content than when using higher caustic soda concentrations, and much of the soda ash value (total alkali) in the solution is present as sodium bicarbonate which complicates the processing into soda ash. No attempt was made to explain how this semi-dilute sodium bicarbonate/carbonate mixture could be economically converted into soda ash.

While solution mining of virgin trona and other soluble evaporites has been carried out, it has been found difficult to carry out such mining in abandoned mined-out underground areas where vast mounts of trona remain unmined. In areas such as Green River, conventional mining is carded out using the room and pillar method which requires large trona pillars from 84 to 108 inches thick to be left behind to support the roof. Additionally a two foot thick roof of trona is customarily maintained in the mine to assure a secure roof, since a shale layer above the trona ore bed is much weaker structurally than the trona ore. As a result the room and pillar method is usually designed to extract only about 40% of the trona ore, leaving about 60% of the trona ore behind in isolated and abandoned mined-out areas of the mine. These abandoned mined-out areas are separated from other areas of the mine in which mechanical mining is being carried out (i.e. an operational mine panel) by large solid blocks of trona (barrier pillars) up to two square miles in area. These barrier pillars, normally longer than they are wide, isolate the abandoned mine areas to protect the operational mine panel from any shift or collapse of the roof in the abandoned mine area from affecting the operational mine panel in which miners and machines are present.

Solution mining of these abandoned mined-out areas by conventional means is not feasible because numerous mine development drifts (connecting tunnels) would have to be developed (i.e. drilled or carved out as with a continuous mining machine) within these large barrier pillars to connect the operating mined panels to the isolated and abandoned mined-out panels. Additional complications arise because men and machines cannot enter the unsafe mined-out area whose roof is usually caving and/or has been lowered because of yielding pillars that slowly are compressed in height with time. Further, these mined-out areas are no longer ventilated, allowing methane gas concentrations to rise, and create an unsafe environment for men and machines. Also, the development panels must enter the mined-out area at its lowest elevation to ensure proper drainage of the desired high specific gravity liquor (containing the most dissolved trona) during the solution mining process. In all events since the collection, containing and pumping to the surface of the solution-mined trona would have to be done in the operating mine panel area where men can work and machines can be serviced in a safe area, some connection would have to be made through the barrier pillars from the operating mined panels to the mined-out area located as far as two miles away underground. Conventional technology does not afford a practical or economically feasible method of achieving this connection.

It has now been found that these obstacles can be overcome by a process for solution mining isolated, mechanically mined-out areas of soluble evaporite ore to recover remaining ore reserves, wherein the mined-out areas are separated from an operational mine area by barrier pillars of the evaporite ore, by drilling at least one vertical well bore from the surface to a predefined distance above the evaporite ore body, converting the drilling of the vertical well bore to a substantially horizontal well bore at a predetermined distance below the ground level, directionally drilling parallel to and within the evaporite ore body to form a well bore one end of which is connected to the mined-out area, developing a connection from the operating mine area to the other end of the well bore, drilling an injection well from the surface into the mined-out area, injecting an aqueous solvent into the injection well, passing the solvent into the mined-out area, removing solvent enriched in dissolved evaporite ore from the mined-out area, passing enriched solvent from the mined-out area into a well bore connecting the mined-out area and the operational mine area, removing enriched solvent from the well bore end connected to the operational mine area and recovering the enriched solvent.

Figure 1:
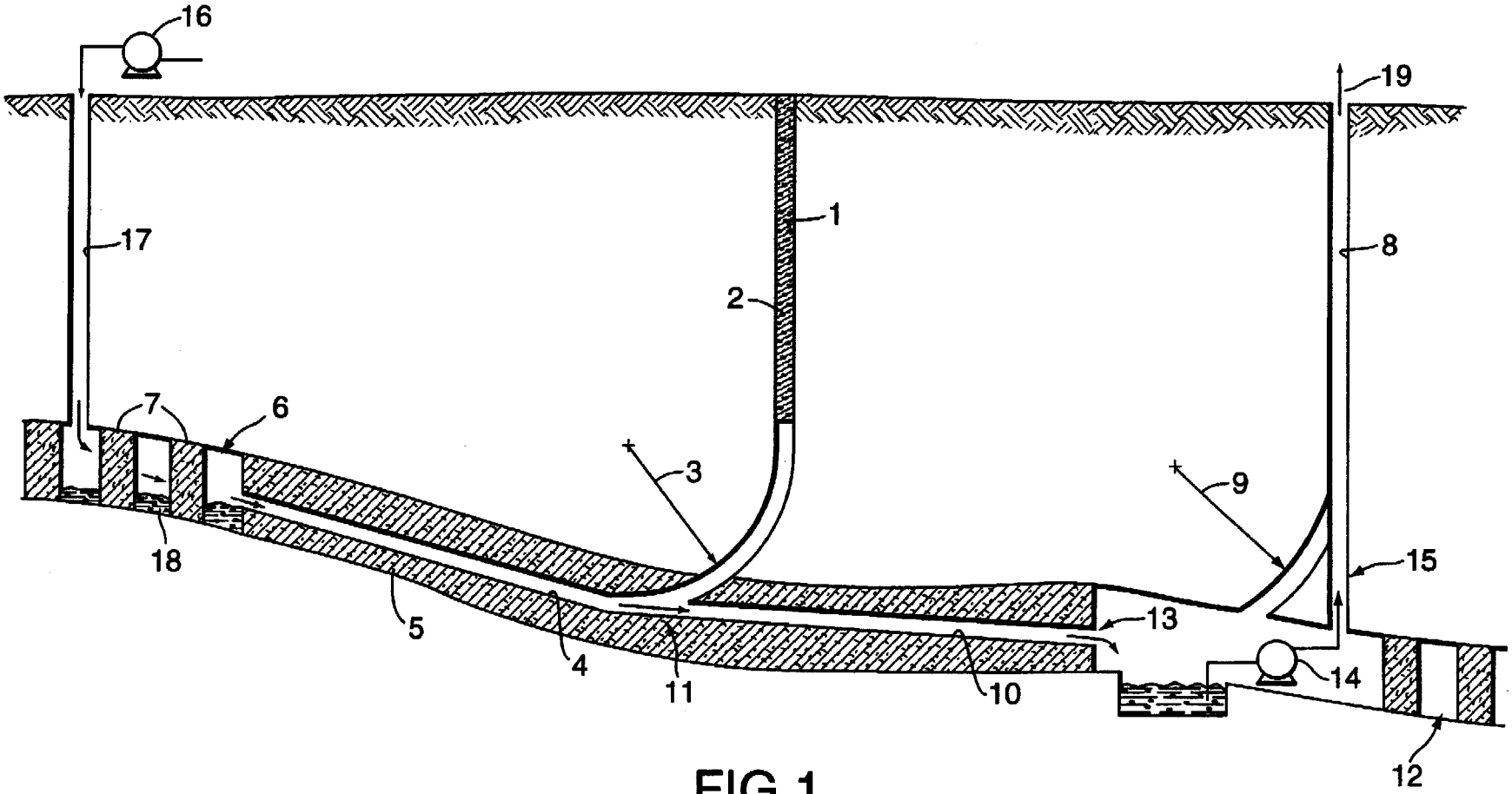
FIG. 1 is a diagram in a schematic form for carrying out the instant process in its preferred form.

The term "TA" or "Total Alkali" as used herein refers to the weight percent in solution of sodium carbonate and/or sodium bicarbonate (which latter is conventionally expressed in terms of its equivalent sodium carbonate content). For example, a solution containing 17 weight percent $Na_2CO_3$ and 4 weight percent $NaHCO_3$ would have a TA of 19.5 percent.

In carrying out the present invention the isolated and abandoned mined-out area (also referred to as the "isolated mine panel") can be connected to the operational mine panel by the use of either a single directionally drilled well bore or by the use of a plurality of directionally drilled well bores joined together to form an underground pipe line. In the preferred embodiment of this invention, whether a single or multiple well bores are drilled, the elevation of the isolated mine panel is normally higher than that of the operational mine panel; the net positive elevation difference between these two panels will supply the driving force to maintain flow through the underground pipe line to the operational panel. However, as will be described in a further embodiment of this invention it is possible for the operational mine panel to be higher than the isolated mine panel where it is desired to increase the liquid retention time of the dissolving liquor for the purpose of maximizing recovery of the soluble evaporite ore being solution mined. In such instances the injection solvent is subject to controlled ponding in certain areas of the isolated and abandoned mine to increase saturation of the solvent injected into the mine so that the exiting liquor has increased total alkali values.

In carrying out the present invention employing a single directional well bore where the distance between the isolated mine panel and the operational mine panel is less than about 5,280 feet long, a single vertical well bore is drilled from the surface down to a predetermined depth above the essentially horizontally positioned ore bed. At this predetermined depth the well bore is then changed in its direction of drilling so that it is drilled on a radius which will intersect the horizontally running trona ore body. This technique for changing the direction of a well being drill from the vertical direction to a horizontal direction (also termed directional drilling) is well known in the art and need not be described in detail to those skilled in the art of well drilling. As the well bore intersects the ore body and changes direction to a horizontal well bore it is drilled parallel to and contained within the trona ore body. The horizontal well bore is then continued to be drilled up dip through the ore body until the isolated and abandoned mined out area is encountered. After the well bore is connected to the isolated and abandoned mined out area, the operational mine panel is advanced (mined forward) until the horizontal portion of the well bore is encountered, thereby making a complete connection between the isolated and abandoned mined out panel and the operational mine panel.

Upon completion of these steps an underground pipe line will exist between the isolated mined-out area and the operational mine panel. The next step is the drilling of one or more cased injection wells up dip from the underground pipe line from the surface down to the abandoned and isolated mined-out area. The horizontal distance between the injection well or wells and the underground pipe line is dependent upon the angle of dip, the anticipated flow path and the flow rate. Thereafter solution mining activities can commence by injection of the solvent into the injection well or wells and into the underground abandoned mined-out area. Once injected, the solvent flows through the mined-out area dissolving trona or other soluble evaporite ore and, now enriched with dissolved ore, flows to the underground pipe line intake. As the near saturated liquor flows through the underground pipe line, which is between a hundred and five thousand two hundred and eighty feet long, the liquor continues to dissolve trona, or other soluble evaporite ore, thereby increasing the cross sectional area of the pipe line. The unique process of dissolving the trona or other evaporite ore within the pipe line not only saturates the solvent with respect to its TA value, but stops pipe line blockage which might otherwise result due to a build up of insoluble shale or mine roof cave-ins by dissolving the trona or other soluble evaporite ore adjacent to the blockage and making a new section of the underground pipe line. The enriched solvent exits the underground pipe line and goes to a collection sump located in the advanced mining panel which is included in the operational mine portion of the mine and there it is pumped to the surface via a second cased well bore. This cased well bore can be the vertical portion of the original well bore used to directionally drill the initial well bore down to the trona or other soluble evaporite ore bed and which has been cased for use as an exit well for the enriched solvent removed from the collection sump.

In the above description of one embodiment of the invention, the distance between the underground abandoned mined out area and the operating mine panel area was about 5,280 feet. However, when a distance between these two areas is greater than about 5,280 feet it requires multiple well bores connected in series to form the underground pipe line between these respective areas. The reason is that directional drilling technology is currently at its upper limit beyond 5280 feet. At greater distances vertical and horizontal controls decrease in accuracy and the drilling equipment is at the upper end of its capabilities. One cannot rely on horizontal drilling beyond this distance for accurate drilling to remain within the trona or other soluble evaporite ore bed. By using multiple well bores the accuracy of the horizontal drilling can be maintained and the well bores can be connected together to yield the underground pipe line required between the various areas. For example, if the remote and abandoned mined-out area was two miles away from the operational panel a first well bore would be drilled a distance of 5,280 feet down dip from the isolated and abandoned mined-out area. This first well bore would begin to be drilled from the surface a horizontal distance of 5,280 feet down dip from the abandoned mined-out area and the well bore would be drilled vertically until it reached a predetermined point above the ore body. Thereafter the direction would be changed from vertical drilling to horizontal drilling and the well bore would be drilled horizontally into the trona, or other soluble evaporite ore, zone horizontally until the well bore entered the abandoned mined out area. A second well bore is then drilled the same way as the first well bore but this one would be at a distance of 10,560 feet down dip from the isolated and abandoned mined-out area and this too would be horizontally drilled 5,280 feet in a direction to ensure it would intercept the point were the first well bore turned horizontally into the trona (or other soluble evaporite) ore zone. After connection of the two horizontal well bores the pipeline is completed by advancing (mining forward) the operational mine panel until the horizontal portion of the second well bore is encountered. In this way the underground and abandoned mined-out area is connected to the operational mine panel area by the pipe line which has been drilled by two well bores and connected underground to form a single pipeline.

In this embodiment of the invention, similar to that described in the first embodiment of the invention above, in selecting the underground locations for multiple horizontal well bores to form an underground pipeline, the elevation of the point where the first well bore intersects the remote mine panel must be greater than the elevation of the point where the second or final multiple well bore is connected to the operational panel. The net positive elevation difference between these areas is the driving force required to maintain flow between the panels. In the third embodiment of the present invention the one or more directional well bores are situated in a manner that will necessitate controlled ponding in the lower portion of the isolated and abandoned mined out panel. This embodiment, whether used with single or multiple direction well bores, is designed to maximize TA strength of the recovered liquor by increasing the retention time that the liquor used for solution mining is in contact with the ore being dissolved. In certain isolated and abandoned mined out areas of the mine controlled ponding of the injection solvent is highly desirable to increase the total alkali content of the liquor exiting the isolated mined-out panel. Such ponding keeps the injection solvent in contact with the ore for greater periods of time and results in obtaining higher ore concentrations in the injection solvent to the point where it approaches saturation.

In this embodiment, ponding can be accomplished in the abandoned mined-out panel by either of two methods, each of which can utilize either single or multiple directional well bores. In the first ponding method it is desired to have the operating mine panel at a higher elevation compared with the isolated and abandoned mined-out panel. In this case either single or multiple horizontal well bores are drilled to form a pipe line between the operating mine panel and the isolated mined out panel as described previously in this specification. This results in an underground pipeline connecting the isolated mine panel with the operational mine panel in which the location of the pipeline intake for the underground pipeline at the isolated mine panel is at a lower elevation than the discharge location of the pipeline at the operational mine panel. The volume of solvent which is captured in the pond in the isolated mine panel is defined by the difference in elevation of the two panels and the geometry of the mine panel. To ensure that the solvent exiting the isolated mine panel is as close to saturation as possible, the liquid draw off point, that is the underground pipeline intake, is preferably located at the lowest point in the isolated mine panel. This assures that as the liquor becomes saturated with a respect to total alkali, this high density liquor will sink to the bottom of the pond due to density stratification and will be drawn off into the pipeline intake at the low spot in the isolated mine panel.

The second underground ponding method utilizes either single or multiple direction well bores to form an underground pipeline between an operating mine panel and an isolated mined out panel in which the elevation of the isolated mined-out panel is greater than the operating mine panel as described above, except that in this case the pipeline follows the ore body contours in such a way as to create a ridge which is higher in elevation than both panels. In this second ponding method ponding in the isolated mined-out panel is controlled by drilling one or more of the horizontal underground pipeline segments up dip within the trona ore (or other soluble evaporite ore) body contours to a higher elevation than the isolated mined out panel pipe line intake and then drilling down dip to intersect the lowest spot of the isolated mined out panel. By creating a high spot between the isolated mined-out panel and the operational panel, the isolated mined out panel will fill with liquor to the elevation of the high spot between the two panels. Once the underground pipeline has been connected to the low spot in the isolated mined-out panel and the operational mine panel is advanced (mined forward) to intersect the horizontal portion of the underground pipeline, which becomes the discharge end of the pipeline, hydraulic communication has been established. With completion of the injection wells, up dip from the pipe line intake, injection of the solvent can commence. Thereafter the isolated and abandoned mined out panel will be inundated with solvent to the same elevation as the high spot in the underground pipe line. When this elevation is incrementally exceeded flow of the solvent will begin in the pipe line. To ensure that the liquor exiting the isolated mined out panel is either saturated or has the highest possible total alkali content, the intake to the underground pipeline is desirably placed at the lowest spot in the isolated mined out panel. As explained previously this will assure that the highest specific gravity liquor, which stratifies to the bottom of the pond, will be continuously drawn off into the underground pipeline.

The invention will now be described with reference to the drawings. In FIG. 1 there is shown the connection of an isolated and abandoned mined out area 6 to an operational portion of the mine 12 by means of an underground pipeline formed by connection of two directional drilled well bores. The underground pipeline between the isolated and abandoned mined out panels and the operational mine panels will allow solution mining of the previously unrecoverable trona ore in the isolated and abandoned mined-out panel. To construct such a pipeline the vertical portion of a first directional well bore 1 must be drilled to a predefined elevation above the mine before directional well bore drilling commences. The predefined distance between the vertical portion of the well bore and the mine is designated by the radius 3. After drilling the radius 3, the well bore is drilled within and horizontal to the trona (or other mineral) ore, body 5. The horizontal portion of the directional well bore is drilled up dip for a predetermined distance until the isolated and abandoned mined out area 6 is encountered. After making the connection with the isolated and mined out-area 6, the vertical well bore is cemented 2. With completion of cementing, the first section of the series pipeline is completed. Next the vertical section 8 of a second directional well bore is drilled to a predetermined elevation above the mine. At this predetermined elevation the well bore is drilled on a radius 9 which will intersect the ore body. Once the well bore is drilled horizontally and enters the ore body the well bore 10 will be drilled in the trona (or other mineral) ore body up dip until the first horizontal well bore is encountered at 11. This links the two horizontal well bores drilled by each of the two separate well bore systems. To complete the underground pipeline, the operational mine panel 12 is advanced (mined forward) until the horizontal portion of the second well bore is encountered at 13. This connects the exit end of the underground pipeline to the operational mine panel. The next task is to install the collection and pumping facilities so that the enriched solvent can be pumped to the surface for recovery of the alkali values. Suitable collection and pumping facilities 14 are then installed at the end of the pipeline 13 in the operational mine panel while the vertical portion of the second well bore 8 must be extended into the mine opening and cased 15. In this way the pumping facilities 14 can be connected to the cased well 15 and 8 to allow the solvent enriched in total alkali values to be pumped to the surface for recovery of these alkali values. To complete the process the injection wells 17 are drilled and cased for introduction of the solvent. The injection and solution mining process begins with the injection of the solvent via a surface pump station 16 down cased well 17 into the isolated and abandoned mined-out area 6. Once the solvent enters the mine, the pillars 7 in the isolated and abandoned mined-out area begin to dissolve and the near saturated total alkali liquor 18 enters the inlet of the underground pipeline. As the liquor 18 gravity flows through the underground pipeline formed from the series pipeline 4 and 10, the ore 5 is dissolved, further saturating the liquor. With trona or other mineral dissolution taking place the underground pipeline formed from series pipeline 4 and 10 increases in cross sectional area. When blockage or cave-in occurs within the underground pipeline the unsaturated liquor will dissolve the ore adjacent to the problem area and form a new section of pipeline. The saturated liquor exiting the underground pipeline, formed by connection of 4 and 10, will be collected in the advanced mining panel 12 and be pumped by 14 to the surface via the cased second well bore 15 and 8. Liquor which is either saturated or near saturated 19 exits the mine for processing of its TA values.

Figure 2:
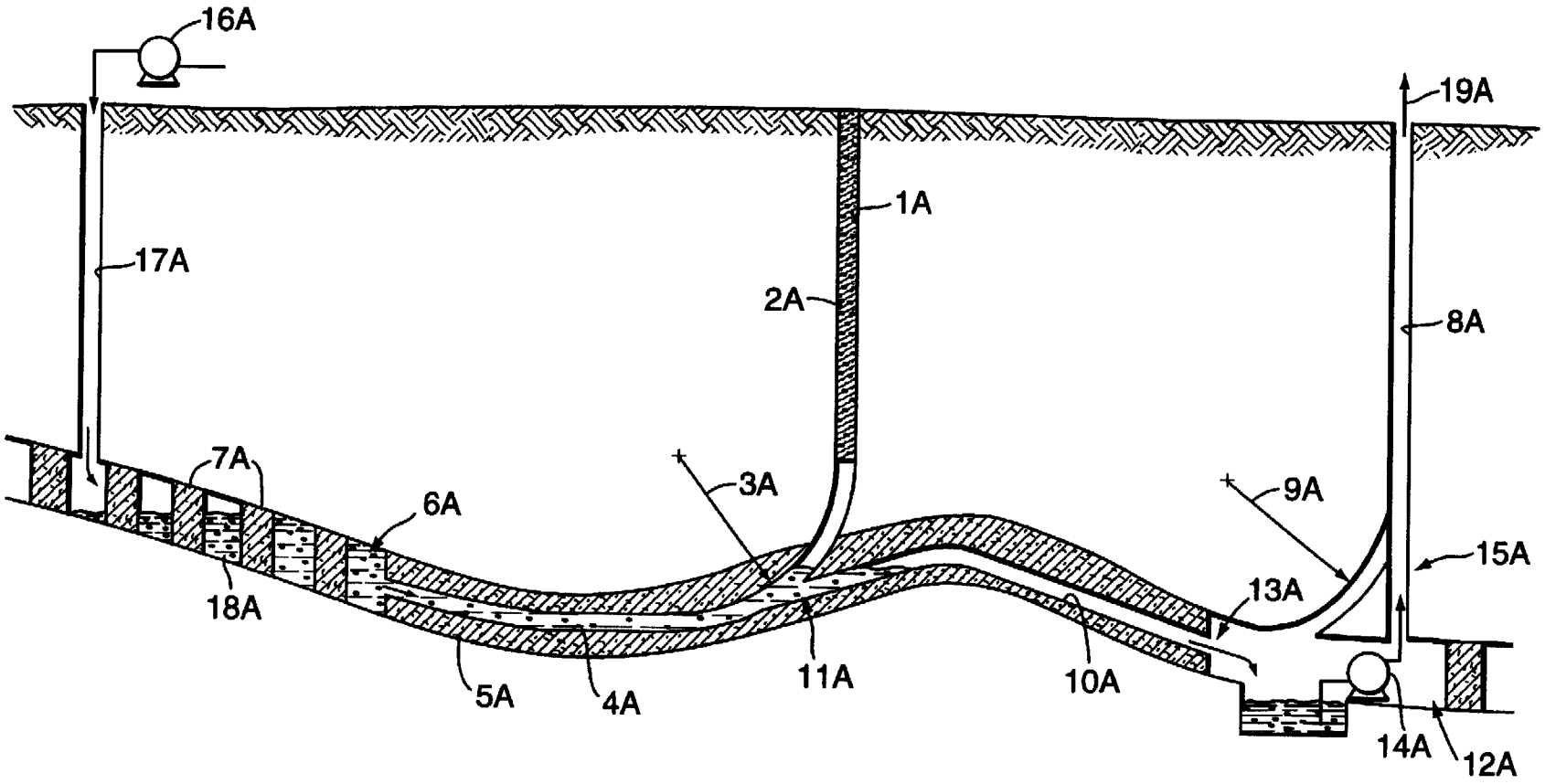
FIG. 2 is a diagram in a schematic form of an alternate mode of carrying out the instant process in which the injection solvent forms a pool in the mined-out area being solution mined.

In FIG. 2 there is shown a similar underground pipeline linking together an isolated mined-out panel and an operational mine panel but in this case the pipeline follows the ore-body contours in such a way as to create a ridge which is higher in elevation than both panels. This causes ponding to take place in the isolated and abandoned mined-out panel. In this case the first directional well bore 1A is drilled to a predefined distance from the surface and then is drilled on a radius 3A until the well bore is within a horizontal trona (or other mineral) ore body 5A. The horizontal portion of the directional well bore is drilled within the ore body for a predetermined distance until the isolated and abandoned mined-out area 6A is encountered. After making the connection with the abandoned and isolated mined-out area 6A, the vertical well bore is cemented 2A. Next, the vertical section 8A of the second directional well bore is drilled to a predetermined elevation above the mine. Thereafter the well bore is drilled on a radius 9A which will intersect the trona (or other mineral) ore body. Once in the ore body, the well bore 10A will be drilled first up dip and then down dip as it follows the ore body contours until it joins with the first horizontal well bore 11A thereby creating a low spot. The underground pipeline is then completed by advancing (mining forward) the operational mine panel 12A until the horizontal portion of the second well bore is encountered 13A. Collection and pumping means 14A are installed in the operational part of the mine and connected to the second well bore 8A which is cased and extended via 15A into the mine opening. Further injection wells 17A are drilled and cased and a surface pump station 16A is installed for injection of solvent. In operation the injection and solution mining process begins with the injection of solvent via surface pump station 16A into cased injection well 17A and from there into the abandoned and mined-out area 6A. The solvent level 18A continues to build in the abandoned and mined-out area 6A until it reaches a level equivalent to the high point of the underground pipeline. This forms a pond in the abandoned and mined out area 6A and in part in the pipeline 4A. As more solution is added, the near saturated solution in the pipeline spills over and flows into the collection and pumping station 14A in the operational mined panel. From there the solution is pumped via pump 14A through cased wells 15A and exits as 19A where it is sent for recovery of its TA values. In this embodiment the ponding of the solvent in the abandoned and mined-out area 6A permits more contact time between the solvent and the ore thereby permitting a more concentrated solution to be formed up to and including saturation of the solvent.

In the above drawings and descriptions the underground pipeline is shown by connection of two well bores in series. It is obvious that the underground pipeline can also be formed from a single well bore or from a plurality of well bores which are connected in series. It is not intended that the invention be limited to a two well bore system but rather that it encompasses anything from 1 to a plurality of well bores which can be connected together to form an underground pipe line.

What is claimed is:

1. A process for solution mining isolated, mechanically mined-out areas of soluble evaporite ore to recover remaining ore reserves, wherein said mined-out areas are separated from an operational mine area by barrier pillars of said evaporite ore, comprising drilling at least one vertical well bore from the surface to a predetermined distance above the evaporite ore body, converting the drilling of said vertical well bore to a substantially horizontal well bore within the evaporite ore body at a predetermined distance below the ground level, continuing the drilling parallel to and within the evaporite ore body to form a well bore one end of which is connected to said mined-out area, developing a connection from the operating mine area to the other end of said well bore, drilling an injection well from the surface into said mined-out area, injecting an aqueous solvent into said injection well, passing the solvent into said mined-out area, removing solvent enriched in dissolved evaporite ore from said mined-out area, passing enriched solvent from said mined-out area into said well bore connecting said mined-out areas and the operational mined area, removing enriched solvent from the well bore end connected to the operational mine area and recovering the enriched solvent.

2. Process of claim 1 wherein the enriched solvent is pumped from the operational mine area through the vertical portion of a well bore to the surface for recovery.

3. Process of claim 1 wherein the evaporite ore is trona.

4. Process of claim 1 wherein the solvent is water or an aqueous solution.

5. Process of claim 1 wherein a plurality of vertical well bores from the surface are drilled and converted to substantially horizontal well bores and said horizontal well bores are interconnected with each other within the evaporite ore body to form said well bore connecting said mined-out areas and said operational mine area.

* * * * *